US009622511B2

(12) United States Patent
Zhu

(10) Patent No.: US 9,622,511 B2
(45) Date of Patent: Apr. 18, 2017

(54) LEAKPROOF ATOMIZER

(71) Applicant: SHENZHEN KANGER TECHNOLOGY CO., LTD., Shenzhen (CN)

(72) Inventor: Xiaochun Zhu, Shenzhen (CN)

(73) Assignee: Shenzhen Kanger Technology Co., Ltd., Shenzhen (CN)

( * ) Notice: Subject to any disclaimer, the term of this patent is extended or adjusted under 35 U.S.C. 154(b) by 856 days.

(21) Appl. No.: 13/966,824

(22) Filed: Aug. 14, 2013

(65) Prior Publication Data

US 2014/0360514 A1 Dec. 11, 2014

(30) Foreign Application Priority Data

Jun. 6, 2013 (CN) ..... 2013 1 0223283

(51) Int. Cl.
*A24F 47/00* (2006.01)

(52) U.S. Cl.
CPC ..... *A24F 47/008* (2013.01)

(58) Field of Classification Search
None
See application file for complete search history.

(56) References Cited

U.S. PATENT DOCUMENTS

2013/0306065 A1* 11/2013 Thorens ..... A24F 47/008 128/202.21

* cited by examiner

*Primary Examiner* — Michael H Wilson
*Assistant Examiner* — Katherine Will
(74) *Attorney, Agent, or Firm* — Muncy, Geissler, Olds & Lowe, P.C.

(57) ABSTRACT

A leakproof atomizer includes a cigarette holder assembly, an atomization assembly, a heating assembly, and a liquid storage assembly. The liquid storage assembly is provided with an annular wall for dividing an internal cavity thereof into a first and a second liquid storage chambers in communication with each other via liquid holes in the annular wall. When the liquid storage assembly is assembled with the heating assembly and the cigarette holder assembly is disassembled from the liquid storage assembly, a bottom portion of the atomization assembly is separated from the heating assembly and hermetically connected with the liquid holes. When both the cigarette holder assembly and the heating assembly are assembled with the liquid storage assembly, the cigarette holder assembly presses downwards the atomization assembly, the atomization assembly is separated from the liquid holes, and the bottom portion of the atomization assembly is press-fitted with the heating assembly.

10 Claims, 6 Drawing Sheets

LEAKPROOF ATOMIZER

TECHNICAL FIELD

The present disclosure relates to atomizers, and more particular to a leakproof atomizer.

BACKGROUND ART

An atomizer, also known as an electronic cigarette or a virtual cigarette, is mainly used for stopping smoking and substituting a cigarette, has an appearance the same as the cigarette and a taste similar to the cigarette, and even has much more flavor than common cigarettes; in addition, smoke, taste and feeling can be obtained from an atomizer, just like a cigarette.

Current atomizers generally are composed of a cigarette holder assembly, an atomization assembly, a heating assembly and a liquid storage assembly, wherein the cigarette holder assembly, the liquid storage assembly and the heating assembly are assembled sequentially from top to the bottom, and the atomization assembly is mounted in the liquid storage assembly, and wherein the liquid storage assembly has only one chamber for storing tobacco liquid, which chamber is directly connected to the heating assembly; when tobacco liquid is injected, the tobacco liquid in the chamber inevitably leaks into the heating assembly, and flows out of the heating assembly to the outside, which not only causes waste, but also causes a hygienic problem.

SUMMERY OF THE PRESENT DISCLOSURE

An object of the present disclosure is to provide a leakproof atomizer, which can solve the problem of tobacco liquid flowing out of the heating assembly when tobacco liquid is injected.

In order to achieve the object, a technical solution adopted by the present disclosure is as follows:

a leakproof atomizer, comprising a cigarette holder assembly, an atomization assembly, a heating assembly, and a liquid storage assembly, wherein the cigarette holder assembly, the liquid storage assembly and the heating assembly are assembled sequentially from top to bottom, and the atomization assembly is located in the liquid storage assembly; the cigarette holder assembly is provided with a first smoke duct, the atomization assembly is provided with a second smoke duct, and the heating assembly is provided with a third smoke duct, a fiber rope and a heating wire, and the first smoke duct, the second smoke duct and the third smoke duct being in communication with one another; both end portions of the fiber rope are located in the second liquid storage chamber, and a middle portion thereof is located in the third smoke duct; the heating wire is wound around the middle portion of the fiber rope; the liquid storage assembly is provided with an annular wall for dividing an internal cavity thereof into a first liquid storage chamber and a second liquid storage chamber, and the annular wall is provided with liquid holes for communicating the first liquid storage chamber with the second liquid storage chamber; a top portion of the atomization assembly is located in the first liquid storage chamber, and a bottom portion of the atomization assembly is located in the second liquid storage chamber;

when the liquid storage assembly is assembled with the heating assembly and the cigarette holder assembly is disassembled from the liquid storage assembly, the atomization assembly is located in a first position in which the bottom portion of the atomization assembly is separated from an outer wall of the third smoke duct of the heating assembly, and the bottom portion of the atomization assembly is hermetically connected with the liquid holes of the annular wall, so as to isolate the first liquid storage chamber from the second liquid storage chamber; and when both the cigarette holder assembly and the heating assembly are assembled with the liquid storage assembly, a bottom portion of the cigarette holder assembly presses downwards the top portion of the atomization assembly, thus driving the atomization assembly into a second position in which the atomization assembly is separated from the liquid holes of the annular wall and the bottom portion of the atomization assembly is press-fitted with the outer wall of the third smoke duct of the heating assembly, so as to communicate the first liquid storage chamber with the second liquid storage chamber and to isolate the second smoke duct from the second liquid storage chamber.

Preferably, the atomization assembly comprises a pressing circle, a return spring, an atomization rod, a pressing ring and a seal ring; wherein the pressing circle is fixedly mounted at the top portion of the atomization rod, and the pressing ring is fixed mounted at the bottom portion of the atomization rod; a middle portion of the pressing circle is located in a central through-hole of the atomization rod, and a top edge thereof is located above a top edge of the atomization rod; a middle portion of the pressing ring is located in the central through-hole of the atomization rod, and a bottom edge thereof is located below the bottom edge of the atomization rod and protrudes radially outwards with a receiving portion, and the seal ring is fitted on the receiving portion; a top end of the return spring is connected to the middle portion of the pressing circle, and the bottom end thereof is connected to the outer wall of the third smoke duct of the heating assembly; the central through-hole of the atomization rod and the central through-hole of the pressing circle communicate with each other to form the second smoke duct; and the first position further means that the seal ring is hermetically connected to a bottom face of the annular wall; and the second position further means that the bottom edge of the pressing ring is press-fitted on the outer wall of the third smoke duct of the heating assembly.

Further preferably, the heating assembly further comprises a pressing rod, a seal sleeve, a heating wire base, an adapting head, a conductive ring and an insulation ring, wherein the fiber rope is mounted in the middle of the heating wire base, a top portion of the heating wire base is mounted at the bottom portion of the pressing rod, the seal sleeve is fitted at the bottom portion of the pressing rod, a top portion of the pressing rod is located in the central through-hole of the atomization rod, and the pressing rod passes through the central through-hole of the pressing ring so that the atomization rod is slidable up and down along the axial direction of the pressing rod, an outer wall of the pressing rod is provided with a convex ring for supporting a bottom end of the return spring, and the conductive ring is assembled with the bottom portion of the heating wire base via the insulation ring; an outer wall of the adapting head is assembled with the bottom portion of the liquid storage assembly, and an inner wall thereof is assembled with the heating wire base; one end of the heating wire is connected to the conductive ring, and the other end thereof is connected to the heating wire base; and the central through-hole of the pressing rod, the central through-hole of the heating wire base and the central through-hole of the conductive ring communicate with one another to form the third smoke duct.

The second position still further means that the bottom edge of the pressing ring is press-fitted on the seal sleeve.

Further preferably, a seal ring is further provided between the heating wire base and the adapting head.

Further preferably, the liquid storage assembly comprises an upper copper ring, a fixing base, a liquid storage tube and a lower copper ring, wherein the upper copper ring is assembled with the bottom portion of the cigarette holder assembly, the fixing base is fixed at a bottom portion of the upper copper ring, a top edge of the liquid storage tube is inserted into a gap formed by connection of the fixing base and the upper copper ring, and a bottom edge of the liquid storage tube is assembled with the heating assembly via the lower copper ring; the annular wall is located at the liquid storage tube; and the atomization rod passes through the central through-hole of the annular wall.

Further preferably, the diameter of the central through-hole of the annular wall is greater than or equal to the outer diameter of the atomization rod.

Further preferably, a guide ring extends radially inwards of the fixing base, the atomization rod also passes through the central through-hole of the guide ring, and the diameter of the central through-hole of the guide ring is greater than or equal to the outer diameter of the atomization rod; and the guide ring is provided with multiple liquid guide holes in communication with the central through-hole of the upper copper ring.

Further preferably, the cigarette holder assembly comprises a cigarette holder and a seal gasket fixedly mounted at a bottom portion of the cigarette holder; the seal gasket is used for pressing downwards the pressing circle; and a central through-hole of the cigarette holder is the first smoke duct.

Preferably, the cigarette holder assembly is mounted at the top portion of the liquid storage assembly in a dismountable connection manner, and a seal is formed between the cigarette holder assembly and the liquid storage assembly.

Preferably, the heating assembly is mounted at the bottom portion of the liquid storage assembly in a dismountable connection manner, and a seal is formed between the heating assembly and the liquid storage assembly.

The present disclosure has the advantageous effect as follows:

The liquid storage tube is divided into upper and lower liquid storage chambers, and when the cigarette holder is opened, the upper and lower liquid storage chambers are isolated from each other, at which time when tobacco liquid is injected into the upper liquid storage chamber, the tobacco liquid will not flow into the lower liquid storage chamber, and as the heating assembly is in communication with the lower liquid storage chamber, no tobacco liquid can flow out of the heating assembly. The present disclosure is also featured by a heating assembly being replaceable, and no strange sound occurring due to residence of water vapor in the atomization rod during cyclic smoking.

DETAILED DESCRIPTION

Figure 1:
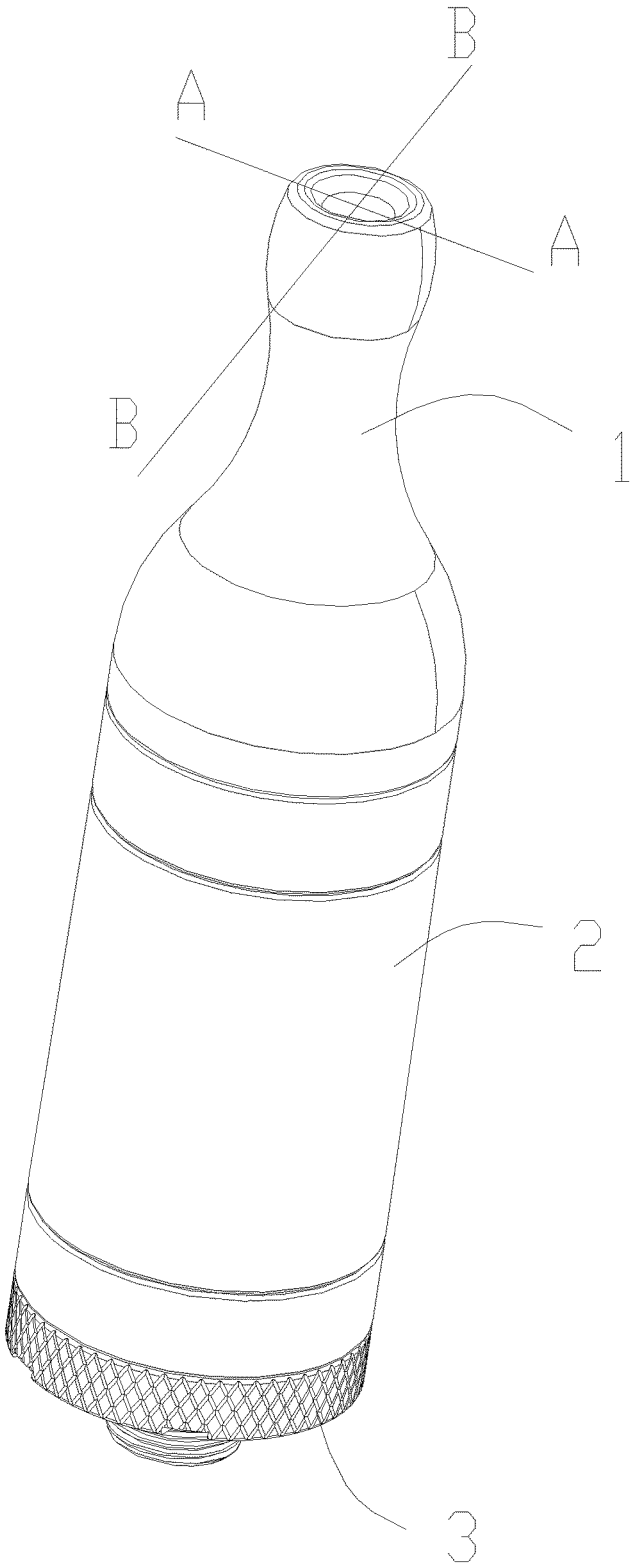
FIG. 1 is an isometric, schematic view of a leakproof atomizer according to one embodiment of the present disclosure.
Figure 2:
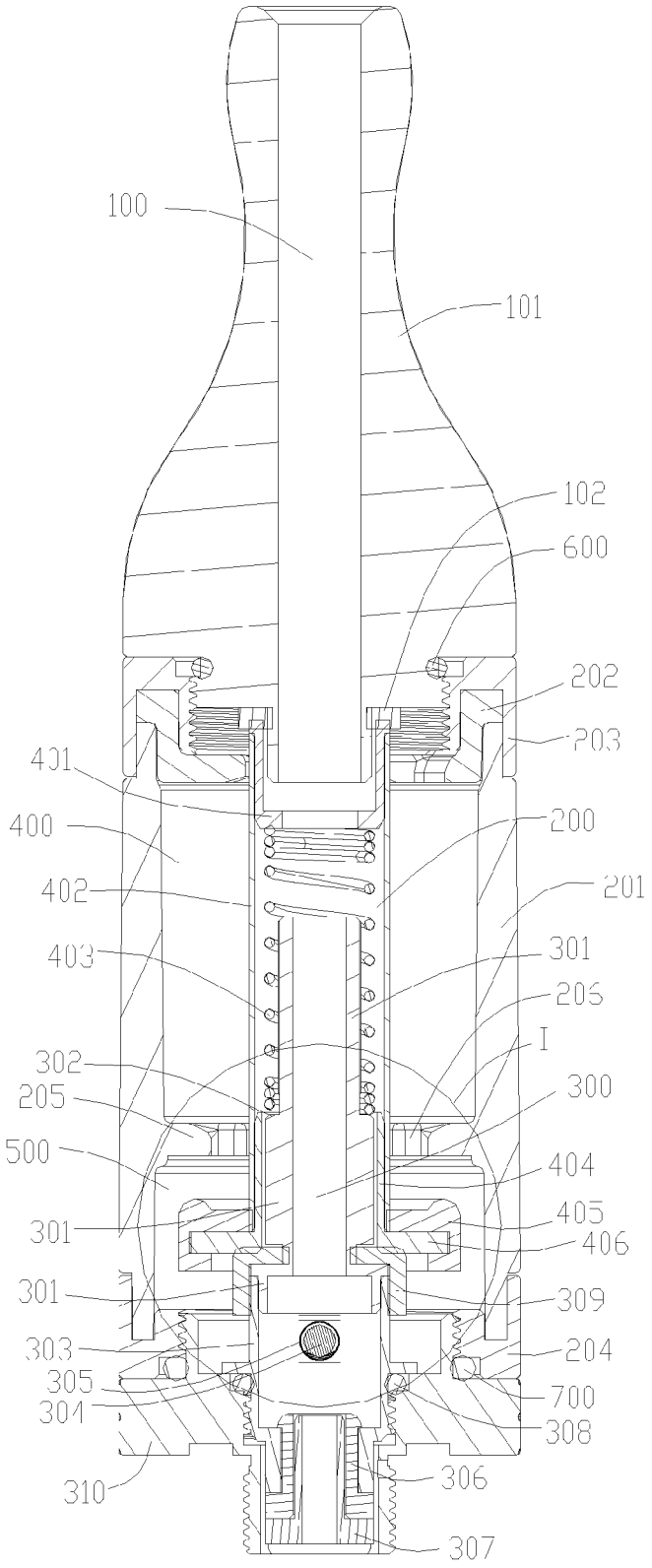
FIG. 2 is a cross-sectional view along the A-A line in FIG. 1.
Figure 3:
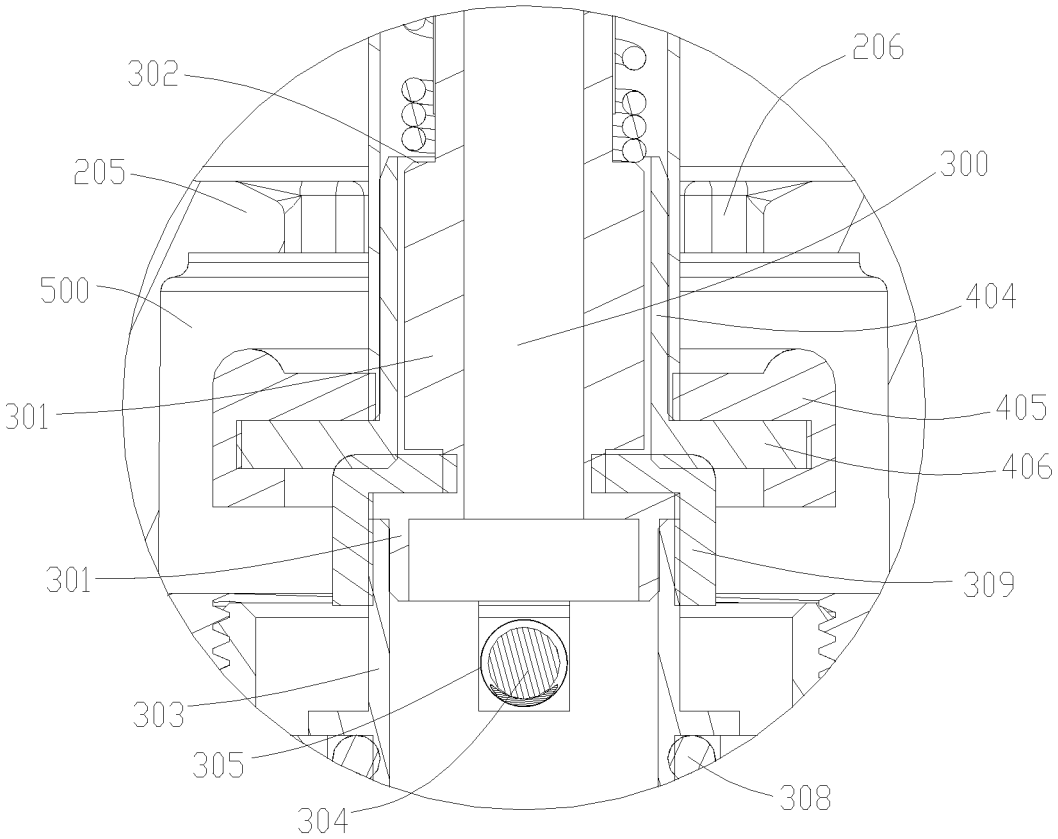
FIG. 3 is an enlarged view of a circled portion I of FIG. 2.
Figure 4:
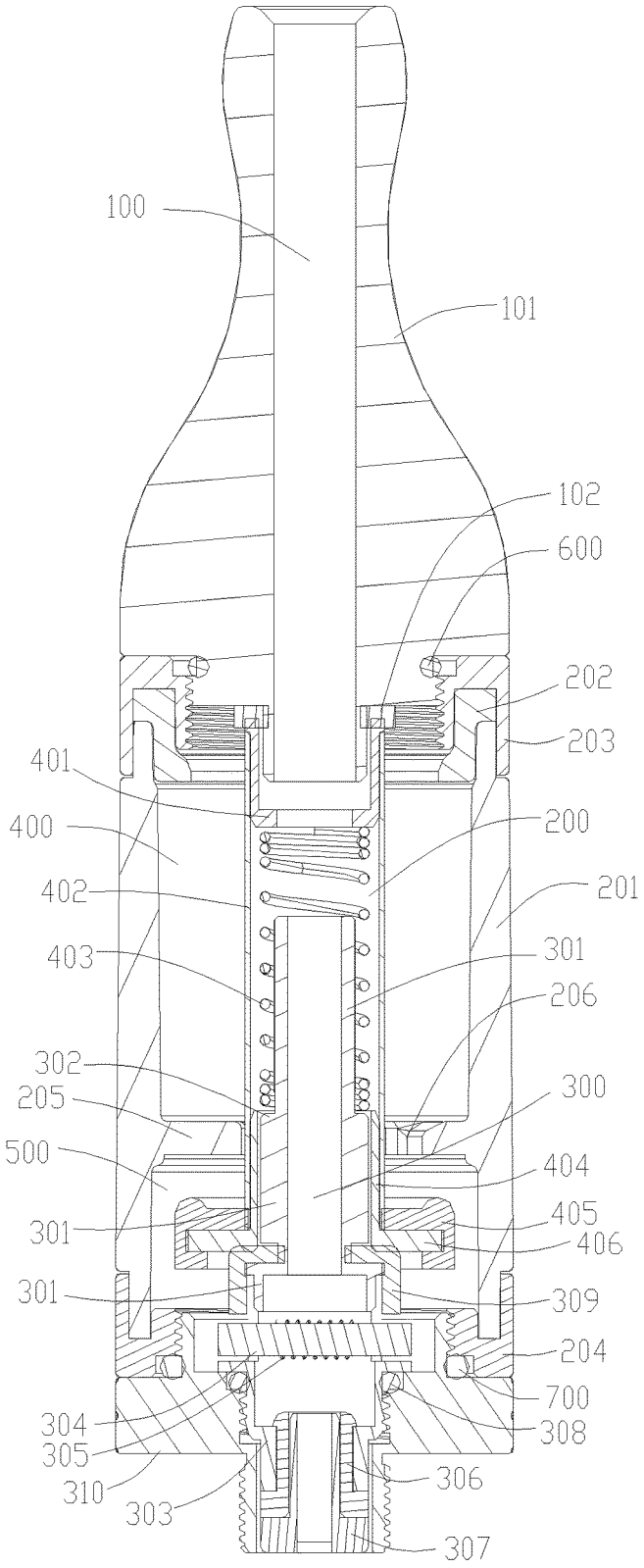
FIG. 4 is a cross-sectional view along the B-B line in FIG. 1.

The present disclosure is further described below in combination with drawings and a specific embodiment.

As shown in FIGS. 1 to 6, a leakproof atomizer includes a cigarette holder assembly 1, an atomization assembly, a heating assembly 3, and a liquid storage assembly 2. The cigarette holder assembly 1, the liquid storage assembly 2 and the heating assembly 3 are assembled sequentially from top to bottom, and the atomization assembly is located in the liquid storage assembly 2.

The atomization assembly includes a pressing circle 401, a return spring 403, an atomization rod 402, a pressing ring 404 and a seal ring 405.

The heating assembly 3 includes a fiber rope 304, a heating wire 305, a pressing rod 301, a seal sleeve 309, a heating wire base 303, a seal ring 308, an adapting head 310, a seal ring 700, a conductive ring 307 and an insulation ring 306.

The liquid storage assembly 2 includes an upper copper ring 203, a fixing base 202, a liquid storage tube 201 and a lower copper ring 204.

The cigarette holder assembly 1 includes a cigarette holder 101 and a seal gasket 102 fixedly mounted at a bottom portion of the cigarette holder 101. The seal gasket 102 is used for pressing downwards the pressing circle 401 of the atomization assembly. The central through-hole of the cigarette holder 101 is the first smoke duct 100.

The specific structure of the atomization assembly is as follows: the pressing circle 401 is fixedly mounted at a top portion of the atomization rod 402, and the pressing ring 404 is fixed mounted at a bottom portion of the atomization rod 402. A middle portion of the pressing circle 401 is located in a central through-hole of the atomization rod 402, and a top edge thereof is located above a top edge of the atomization rod 402. A middle portion of the pressing ring 404 is located in the central through-hole of the atomization rod 402, and a bottom edge thereof is located below a bottom edge of the atomization rod 402 and protrudes radially outwards with a receiving portion 406, and the seal ring 405 is fitted on the receiving portion 406. The central through-hole of the atomization rod 402 and the central through-hole of the pressing circle 401 communicate with each other to form the second smoke duct 200.

The specific structure of the heating assembly 3 is as follows: the fiber rope 304 is mounted at a middle portion of the heating wire base 303, a top portion of the heating wire base 303 is mounted at the bottom portion of the pressing rod 301, the seal sleeve 309 is fitted at a bottom portion of the pressing rod 301, a top portion of the pressing rod 301 is located in the central through-hole of the atomization rod 402, and the pressing rod 301 passes through the central through-hole of the pressing ring 404 so that the atomization rod 402 is slidable up and down along the axial direction of the pressing rod 301, and an outer wall of the pressing rod 301 is provided with a convex ring 302 for supporting a bottom end of the return spring 403, that is, the top end of the return spring 403 is connected to the middle portion of the pressing circle 401, and the bottom end of the return spring 403 is connected to the convex ring 302 of the pressing rod 301. The conductive ring 307 is assembled with the bottom portion of the heating wire base 303 via the insulation ring 306. An outer wall of the adapting head 310 is assembled with the lower copper ring 204 at the bottom portion of the liquid storage assembly 2, and an inner wall thereof is assembled with the heating wire base 303, preferably in such a manner that the adapting head 310 is connected respectively to the lower copper ring 204 and the heating wire base 303 in a threaded connection manner. One end of the heating wire 305 is connected to the conductive ring 307, and the other end thereof is connected to the heating wire base 303. The central through-hole of the pressing rod 301, the central through-hole of the heating wire base 303 and the central through-hole of the conductive ring 307 communicate with one another to form the third smoke duct 300, that is to say, the outer wall of the pressing rod 301, the outer wall of the heating wire base 303, and the seal sleeve 309 together constitute the outer wall of the third smoke duct 300. Both end portions of the fiber rope 304 are located in the second liquid storage chamber 500, a middle portion thereof is located in the third smoke duct 300, and the heating wire 305 is wound around the middle portion of the fiber rope 304. A seal ring 308 is further provided between the heating wire base 303 and the adapting head 310.

The first smoke duct 100, the second smoke duct 200 and the third smoke duct 300 communicate with one another.

The specific structure of the liquid storage assembly 2 is as follows: the upper copper ring 203 is assembled with the bottom portion of the cigarette holder assembly 1, preferably in such a manner that the upper copper ring 203 is in threaded connecting fixation with the bottom portion of the cigarette holder 101. The fixing base 202 is fixed at the bottom portion of the upper copper ring 203, and a top edge of the liquid storage tube 201 is inserted into a gap formed by connection of the fixing base 202 and the upper copper ring 203. A bottom edge of the liquid storage tube 201 is assembled with the adapting head 310 of the heating assembly 3 via the lower copper ring 204. The liquid storage tube 201 is provided with the annular wall 205 for dividing an internal cavity thereof into the first liquid storage chamber 400 and the second liquid storage chamber 500, the atomization rod 402 passes through in the central through-hole of the annular wall 205, the diameter of the central through-hole of the annular wall 205 is greater than or equal to the outer diameter of the atomization rod 402, i.e. the atomization rod 402 is slidable up and down through the annular wall 205 along the axial direction of the liquid storage tube 201, and the annular wall 205 is provided with multiple liquid holes 206 passing through the upper surface and lower surface thereof. The first liquid storage chamber 400 of the liquid storage tube 201 communicates with the central through-hole of the upper copper ring 203, so as to form a liquid injection port. A guide ring (not shown) radially extends inwards of the fixing base 202, the atomization rod 402 also passes through the central through-hole of the guide ring, the diameter of the central through-hole of the guide ring is greater than or equal to the outer diameter of the atomization rod 402, the guide ring is provided with multiple liquid guide holes (not shown) in communication with the liquid injection port, which arrangement can allow the atomization rod 402 to have better directional movement effect under the double guide action of the annular wall 205 and the guide ring.

The pressing circle 401 of the atomization assembly is located in the first liquid storage chamber 400, and the bottom edge of the pressing ring 405 and the seal ring 406 are located in the second liquid storage chamber 500. By means of the seal gasket 102, the bottom portion of the cigarette holder assembly 1 can be hermetically connected to the top portion of the atomization assembly, so that both the first smoke duct 100 and the second smoke duct 200 are isolated from the first liquid storage chamber 400.

In order to enhance the seal, a seal ring 700 is further provided between the adapting head 310 and the lower copper ring 204, and a seal ring 600 is further provided between the cigarette holder 101 and the upper copper ring 203.

Figure 5:
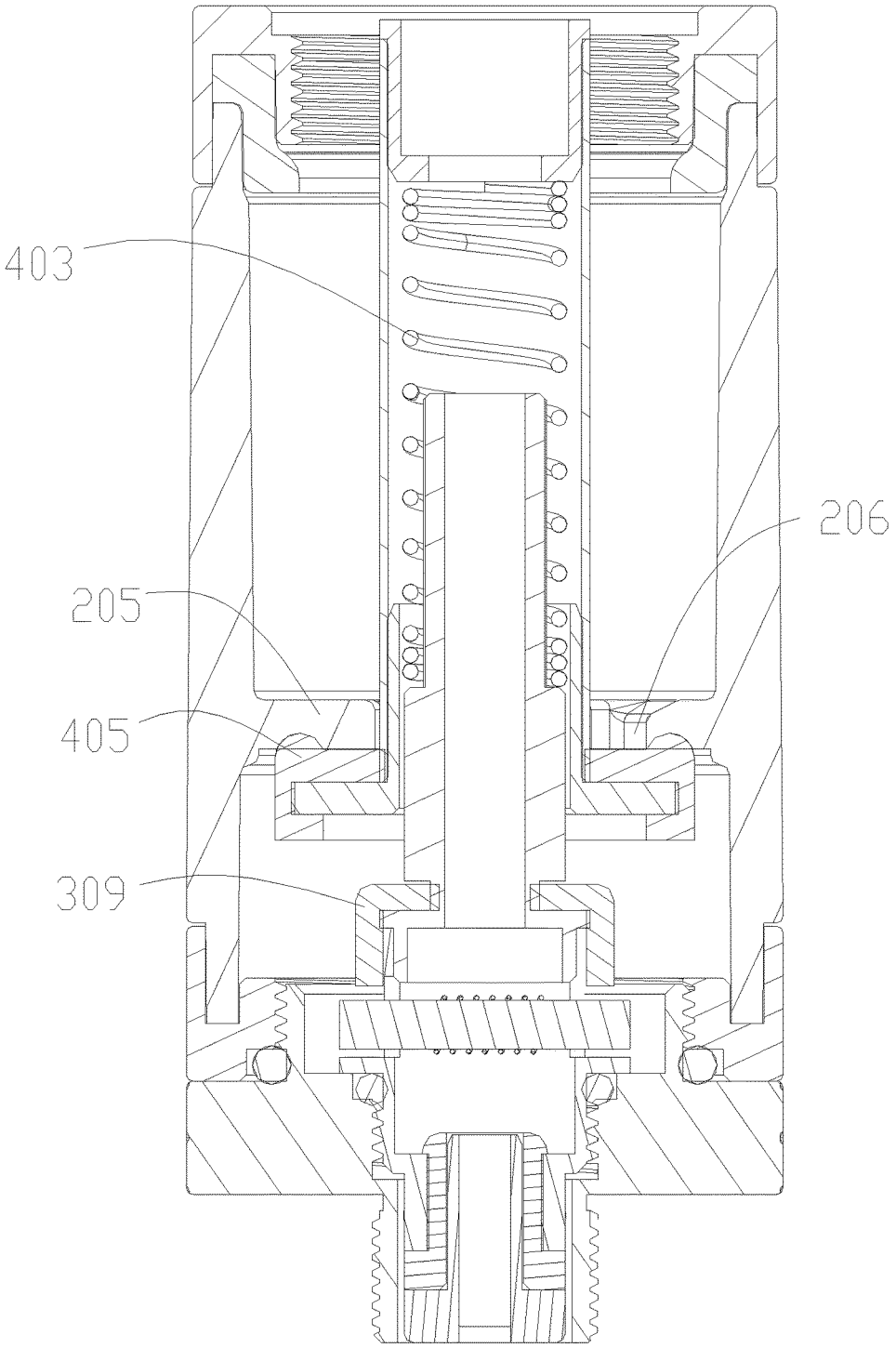
FIG. 5 is a cross-sectional, schematic view of a liquid storage assembly of the leakproof atomizer in a liquid to-be-injected state according to the present disclosure.

This embodiment can be used as follows:

as shown in FIG. 5, the heating assembly 3 is assembled with the liquid storage assembly 2 and a seal is formed, and the cigarette holder assembly 1 is not assembled with the liquid storage assembly 2. The return spring 403 is in a compressed state, and since the bottom end of the return spring 403 is fixed on the convex ring 302 of the pressing rod 301 of the heating assembly 3 and the heating assembly 3 is fixed, the top end of the return spring 403 pushes upwards the pressing circle 401, so as to drive the whole atomization assembly to lift, thereby connecting the seal ring 405 with the bottom face of the annular wall 205 and closing the liquid holes 206, at which time, the atomization assembly is located in a first position, and the first liquid storage chamber 400 is isolated from the second liquid storage chamber 500.

Figure 6:
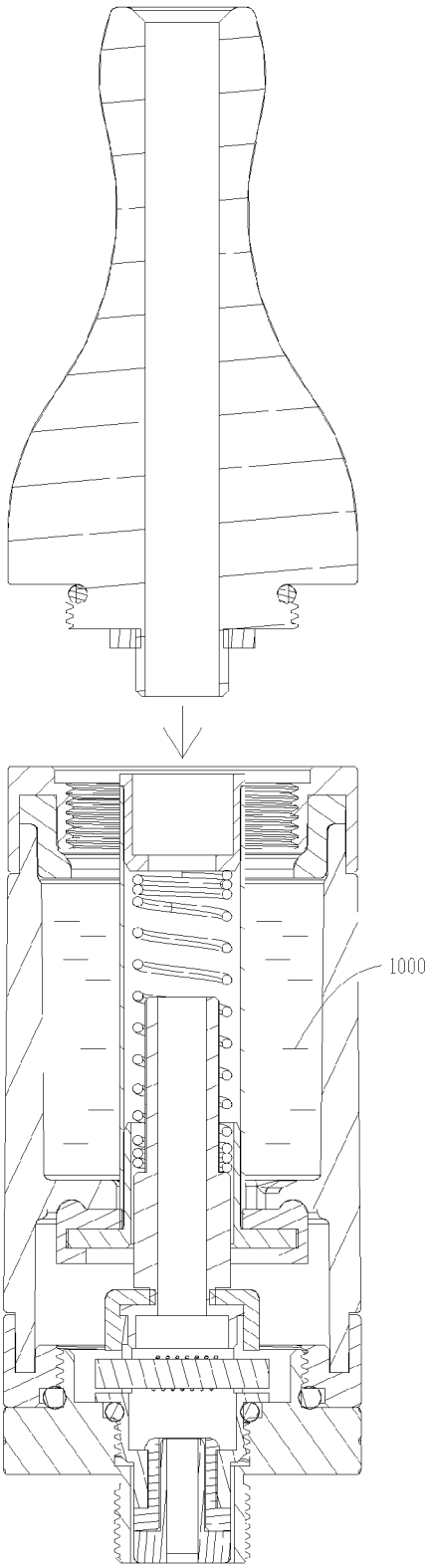
FIG. 6 is a cross-sectional, schematic view of the liquid storage assembly of the leakproof atomizer after liquid is injected according to the present disclosure.

Tobacco liquid 1000 is injected from the liquid injection port of the liquid storage tube 201 to completely fill the first liquid storage chamber 400, as shown in FIG. 6. Then, the cigarette holder assembly 1 is assembled to the top portion of the liquid storage assembly 2 and a seal connection is formed, the seal gasket 102 of the cigarette holder assembly 1 presses downwards the pressing circle 401 of the atomization assembly, moving the whole atomization assembly downwards, and the seal ring 405 is moved away from the bottom face of the annular wall 205 and the bottom edge of the pressing ring 404 is press-fitted on the seal sleeve 309, at which time, the atomization assembly is located in a second position so that the first liquid storage chamber 400 is communicated with the second liquid storage chamber 500, and the tobacco liquid 1000 in the first liquid storage chamber 400 flows into the second liquid storage chamber 500, and at this time, the return spring 403 is in a further compressed state. Also as the bottom edge of the pressing ring 404 is press-fitted on the seal sleeve 309, the gap between the pressing rod 301 and the pressing ring 404 is also plugged, i.e. the second liquid storage chamber 500 is also isolated from the second smoke duct 200.

The adapting head 310 is connected to a corresponding electronic cigarette battery (not shown), so that the heating wire 305, the heating wire base 303 and the conductive ring 307 form a circuit, and the heating wire 305 generates heat. When a user smokes, air flow passes through the fiber rope 304 to carry the tobacco liquid in the fiber rope 304 to the heating wire 305 for contact with the heating wire 305, so that the tobacco liquid is atomized at the high temperature of the heating wire 305 to generate a certain amount of smoke, so as to achieve the effect of smoking. When tobacco liquid is required to be injected again, the cigarette holder 1 is unscrewed and the return spring 403 rapidly restores, the top end of the return spring 403 drives the whole atomization assembly to lift again, so as to seal the seal ring 405 against the annular wall 205 again, and to isolate the first liquid storage chamber 400 from the second liquid storage chamber 500, at which time, an injection operation can be performed.

It can be seen from this embodiment that, the key structure of the embodiment lies in that the liquid storage assembly 2 is provided with the annular wall 205 for dividing the internal cavity thereof into the first liquid storage chamber 400 and the second liquid storage chamber 500, and the annular wall 205 is provided with liquid holes 206 for communicating the first liquid storage chamber 400 with the second liquid storage chamber 500. The top portion of the atomization assembly is located in the first liquid storage chamber 400, and the bottom portion of the atomization assembly is located in the second liquid storage chamber 500.

When the liquid storage assembly 2 is assembled with the heating assembly 3 and the cigarette holder assembly 1 is disassembled from the liquid storage assembly 2, the atomization assembly is located in the first position in which the bottom portion of the atomization assembly is separated from the outer wall of the third smoke duct 300 of the heating assembly 3, and the bottom portion of the atomization assembly is hermetically connected with the liquid holes 206 of the annular wall 205, i.e. the bottom portion of the atomization assembly closes the liquid holes 206 of the annular wall 205, so as to isolate the first liquid storage chamber 400 from the second liquid storage chamber 500. When both the cigarette holder assembly 1 and the heating assembly 3 are assembled with the liquid storage assembly 2, the bottom portion of the cigarette holder assembly 1 presses downwards the top portion of the atomization assembly, thus driving the atomization assembly into the second position in which the atomization assembly is separated from the liquid holes 206 of the annular wall 205, and the bottom portion of the atomization assembly is press-fitted with the outer wall of the third smoke duct 300 of the heating assembly 3, so as to communicate the first liquid storage chamber 400 with the second liquid storage chamber 500 and to isolate the second smoke duct 200 from the second liquid storage chamber 500.

That is to say, by disassembling or assembling the cigarette holder assembly 1 from or with the liquid storage assembly 2, the atomization assembly is moved between the first position and the second position, so as to isolate or communicate the first liquid storage chamber 400 from or with the second liquid storage chamber 500, thereby achieves the effect that tobacco liquid will not flow out of the heating assembly 3 while tobacco liquid is injected.

In addition, the diameter of the central through-hole of the annular wall 205 of the embodiment can also be designed to be greater than the outer diameter of the atomization rod 402, then the gap between the annular wall 205 and the atomization rod 402 can become a channel communicating the first liquid storage chamber 400 with the second liquid storage chamber 500, i.e. as function of the "liquid holes".

For the skilled in the art, other various corresponding modifications and variations can be made according to the technical solution and conception described above, and all these modifications and variations should be within the protection scope of the claims of the present disclosure.

The invention claimed is:

1. A leakproof atomizer, comprising a cigarette holder assembly, an atomization assembly, a heating assembly, and a liquid storage assembly, the cigarette holder assembly, the liquid storage assembly and the heating assembly being assembled sequentially from top to bottom, the atomization assembly being located in the liquid storage assembly; the cigarette holder assembly being provided with a first smoke duct, the atomization assembly being provided with a second smoke duct, and the heating assembly being provided with a third smoke duct, a fiber rope and a heating wire, the first smoke duct, the second smoke duct and the third smoke duct communicating with one another; both end portions of the fiber rope being located in a second liquid storage chamber, a middle portion thereof being located in the third smoke duct; the heating wire being wound around the middle portion of the fiber rope; wherein the liquid storage assembly is provided with an annular wall for dividing an internal cavity thereof into a first liquid storage chamber and the second liquid storage chamber; and the annular wall is provided with liquid holes for communicating the first liquid storage chamber with the second liquid storage chamber; a top portion of the atomization assembly is located in the first liquid storage chamber, and a bottom portion of the atomization assembly is located in the second liquid storage chamber;

when the liquid storage assembly is assembled with the heating assembly and the cigarette holder assembly is disassembled from the liquid storage assembly, the atomization assembly is in a first position in which the bottom portion of the atomization assembly is separated from an outer wall of the third smoke duct of the heating assembly, and the bottom portion of the atomization assembly is hermetically connected with the liquid holes of the annular wall, so as to isolate the first liquid storage chamber from the second liquid storage chamber; and when both the cigarette holder assembly and the heating assembly are assembled with the liquid storage assembly, a bottom portion of the cigarette holder assembly presses downwards the top portion of the atomization assembly, thus driving the atomization assembly into a second position in which the atomization assembly is separated from the liquid holes of the annular wall, and the bottom portion of the atomization assembly is press-fitted with the outer wall of the third smoke duct of the heating assembly, so as to communicate the first liquid storage chamber with the second liquid storage chamber and to isolate the second smoke duct from the second liquid storage chamber.

2. The leakproof atomizer as claimed in claim 1, wherein the atomization assembly comprises a pressing circle, a return spring, an atomization rod, a pressing ring and a seal ring; the pressing circle is fixedly mounted at a top portion of the atomization rod, and the pressing ring is fixedly mounted at a bottom portion of the atomization rod; a middle portion of the pressing circle is located in a central through-hole of the atomization rod, and a top edge thereof is located above a top edge of the atomization rod; a middle portion of the pressing ring is located in the central through-hole of the atomization rod, and a bottom edge thereof is located below a bottom edge of the atomization rod, and protrudes radially outwards with a receiving portion, and the seal ring is fitted on the receiving portion; a top end of the return spring is connected to the middle portion of the pressing circle, and a bottom end thereof is connected to the outer wall of the third smoke duct of the heating assembly; the central through-hole of the atomization rod and a central through-hole of the pressing circle communicate with each other to form the second smoke duct;

the first position further means that the seal ring is hermetically connected on a bottom face of the annular wall; and the second position further means that the bottom edge of the pressing ring is press-fitted on the outer wall of the third smoke duct of the heating assembly.

3. The leakproof atomizer as claimed in claim 2, wherein the heating assembly further comprises a pressing rod, a seal sleeve, a heating wire base, an adapting head, a conductive ring and an insulation ring, wherein the fiber rope is mounted at a middle portion of the heating wire base, a top portion of the heating wire base is mounted at a bottom portion of the pressing rod, the seal sleeve is fitted at the bottom portion of the pressing rod, a top portion of the pressing rod is located in the central through-hole of the atomization rod, and the pressing rod passes through a central through-hole of the pressing ring so that the atomization rod is slidable up and down along the axial direction of the pressing rod; an outer wall of the pressing rod is provided with a convex ring for supporting the bottom end of the return spring, and the conductive ring is assembled with a bottom portion of the heating wire base via the insulation ring; an outer wall of the adapting head is assembled with a bottom portion of the liquid storage assembly, and an inner wall thereof is assembled with the heating wire base; one end of the heating wire is connected to the conductive ring, and the other end thereof is connected to the heating wire base; and a central through-hole of the pressing rod, a central through-hole of the heating wire base and a central through-hole of the conductive ring communicate with one another to form the third smoke duct;

the second position still further means that the bottom edge of the pressing ring is press-fitted on the seal sleeve.

4. The leakproof atomizer as claimed in claim 3, wherein a seal ring is further provided between the heating wire base and the adapting head.

5. The leakproof atomizer as claimed in claim 2, wherein the liquid storage assembly comprises an upper copper ring, a fixing base, a liquid storage tube and a lower copper ring, wherein the upper copper ring is assembled with the bottom portion of the cigarette holder assembly, the fixing base is fixed at a bottom portion of the upper copper ring, a top edge of the liquid storage tube is inserted in a gap formed by connection of the fixing base and the upper copper ring, and a bottom edge of the liquid storage tube is assembled with the heating assembly via the lower copper ring; the annular wall is located at the liquid storage tube; the atomization rod passes through a central through-hole of the annular wall.

6. The leakproof atomizer as claimed in claim 5, wherein the diameter of the central through-hole of the annular wall is greater than or equal to the outer diameter of the atomization rod.

7. The leakproof atomizer as claimed in claim 5, wherein a guide ring extends radially inwards of the fixing base, the atomization rod also passes through a central through-hole of the guide ring, and the diameter of the central through-hole of the guide ring is greater than or equal to the outer diameter of the atomization rod; and the guide ring is provided with multiple liquid guide holes in communication with a central through-hole of the upper copper ring.

8. The leakproof atomizer as claimed in claim 2, wherein the cigarette holder assembly comprises a cigarette holder and a seal gasket fixedly mounted at a bottom portion of the cigarette holder; the seal gasket is used for pressing downwards the pressing circle; and a central through-hole of the cigarette holder is the first smoke duct.

9. The leakproof atomizer as claimed in claim 1, wherein the cigarette holder assembly is mounted at a top portion of the liquid storage assembly in a dismountable connection manner, and a seal is formed between the cigarette holder assembly and the liquid storage assembly.

10. The leakproof atomizer as claimed in claim 1, wherein the heating assembly is mounted at a bottom portion of the liquid storage assembly in a dismountable connection manner, and a seal is formed between the heating assembly and the liquid storage assembly.

* * * * *